US010153620B2

(12) United States Patent
Kiuchi et al.

(10) Patent No.: US 10,153,620 B2
(45) Date of Patent: Dec. 11, 2018

(54) SPARK PLUG

(71) Applicant: NGK SPARK PLUG CO., LTD., Nagoya-shi, Aichi (JP)

(72) Inventors: Kentaro Kiuchi, Kitanagoya (JP); Kazuhiko Mori, Nissin (JP); Hironobu Mizutani, Konan (JP); Yuusuke Teranishi, Aichi (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 15/565,776

(22) PCT Filed: Mar. 28, 2016

(86) PCT No.: PCT/JP2016/001788
§ 371 (c)(1),
(2) Date: Oct. 11, 2017

(87) PCT Pub. No.: WO2016/166943
PCT Pub. Date: Oct. 20, 2016

(65) Prior Publication Data

US 2018/0212405 A1 Jul. 26, 2018

(30) Foreign Application Priority Data

Apr. 17, 2015 (JP) ..... 2015-085181

(51) Int. Cl.
*H01T 13/36* (2006.01)
*H01T 13/02* (2006.01)
*H01T 21/02* (2006.01)

(52) U.S. Cl.
CPC ..... *H01T 13/36* (2013.01); *H01T 13/02* (2013.01); *H01T 21/02* (2013.01)

(58) Field of Classification Search
None
See application file for complete search history.

(56) References Cited

U.S. PATENT DOCUMENTS

2002/0067112 A1 6/2002 Suzuki et al. ..... 313/143
2003/0168955 A1* 9/2003 Suzuki ..... H01T 13/36 313/143

(Continued)

FOREIGN PATENT DOCUMENTS

JP 2002-164147 A 6/2002 ..... F02P 13/00

OTHER PUBLICATIONS

International Search Report issued in corresponding International Patent Application No. PCT/JP2016/001788, dated Jun. 14, 2016.

*Primary Examiner* — Ashok Patel
(74) *Attorney, Agent, or Firm* — Kusner & Jaffe

(57) ABSTRACT

A spark plug having a ceramic insulator held by a crimp portion of a metallic shell. The crimp portion satisfies a relation of A≥1.7 mm and a relation of t≥1.20 mm in a cross section of the crimp portion taken along a plane containing the axial line, where A is the distance between a closest point which is a point within the cross section closest to the ceramic insulator and an intersection at which a first orthogonal line passing through the closest point and orthogonal to the axial line intersects with an outer circumference of the crimp portion, and t is a thickness of the proximal end of the crimp portion.

2 Claims, 6 Drawing Sheets

(56) References Cited

U.S. PATENT DOCUMENTS

| | | | | |
|---|---|---|---|---|
| 2008/0174223 | A1* | 7/2008 | Suzuki | H01T 13/36 313/143 |
| 2012/0153801 | A1* | 6/2012 | Kato | F02P 13/00 313/143 |
| 2013/0154468 | A1* | 6/2013 | Nasu | H01T 13/36 313/141 |
| 2015/0188293 | A1* | 7/2015 | Ozeki | H01T 13/36 313/143 |
| 2015/0340842 | A1* | 11/2015 | Ozeki | H01T 13/36 313/143 |

* cited by examiner

C/B=1.0

C/B=1.5

C/B=1.5

SPARK PLUG

RELATED APPLICATIONS

This application is a National Stage of International Application No. PCT/JP2016/001788 filed Mar. 28, 2016, which claims the benefit of Japanese Patent Application No. 2015-085181, filed Apr. 17, 2015, the entire contents of which are incorporated herein by reference.

FIELD OF THE INVENTION

The present invention relates to a spark plug.

BACKGROUND OF THE INVENTION

A spark plug used for ignition in an internal combustion engine such as a gasoline engine or the like includes a metallic shell for attaching the spark plug to an engine head. The metallic shell has a generally tubular shape. In a state in which a ceramic insulator having a center electrode is inserted into the metallic shell, a crimp portion of the metallic shell is crimped, whereby the metallic shell is assembled to the ceramic insulator (for example, refer to Japanese Patent Application Laid-Open (kokai) No. 2002-164147).

In internal combustion engines, pressures in the combustion chambers thereof have been increased due to higher degree of supercharging and higher compression ratio. Therefore, the ceramic insulator of a spark plug is pressed with a larger force in a direction from a forward end side of the spark plug (the side where a spark gap is formed) toward a rear (proximal) end side thereof. As a result, there is a possibility that the ceramic insulator comes off the metallic shell. To solve this problem, it has been desired to enhance the ceramic insulator retaining performance of the metallic shell.

The present invention has been accomplished to address the above-mentioned problem and can be realized as the following modes.

SUMMARY OF THE INVENTION (1) According to one aspect of the present invention, there is provided a spark plug is provided comprised of a ceramic insulator having a generally tubular shape and a through hole extending in a direction of an axial line, the ceramic insulator including a center electrode on a forward end side of the through hole in the direction of the axial line; and a metallic shell formed in a generally tubular shape and having a crimp portion at a rear end of the metallic shell in the direction of the axial line, the crimp portion being crimped in a state in which the ceramic insulator is inserted into the metallic shell so that the ceramic insulator is held by the metallic shell, wherein the crimp portion satisfies a relation of $A \geq 1.7$ mm and a relation of $t \geq 1.20$ mm in a cross section of the crimp portion taken along a plane containing the axial line, where A is a distance between a closest point which is a point within the cross section closest to the ceramic insulator and a point of intersection at which a first orthogonal line passing through the closest point and orthogonal to the axial line intersects with an outer circumference of the crimp portion, and t is a thickness of a proximal end of the crimp portion. In the spark plug of this mode, the crimp strength of the crimp portion is increased. Therefore, it is possible to decrease the possibility that when the pressure within a combustion chamber of an internal combustion engine in which a forward end portion of the spark plug is disposed increases, the ceramic insulator comes off the metallic shell due to the pressure within the combustion chamber.

(2) In accordance with a second aspect of the present invention, there is provided a spark plug as described above, wherein the crimp portion may satisfy a relation of $0.7 \leq C/B \leq 1.5$, where C/B is the ratio of a distance C to a distance B in the cross section, the distance B being a distance between the closest point and a parallel line which passes through a proximal point of the outer circumference of the crimp portion and which is parallel to the axial line, and the distance C being a maximum distance between the outer circumference of the crimp portion and a second orthogonal line which passes through the proximal point of the outer circumference of the crimp portion and which is orthogonal to the axial line. In this case as well, the crimp strength of the crimp portion is increased. Therefore, it is possible to decrease the possibility that the ceramic insulator comes off the metallic shell.

The present invention can be realized in various other forms. For example, the present invention can be realized as a method of manufacturing a spark plug or as a metallic shell or the like.

DETAILED DESCRIPTION OF THE PREFERRED EMBODIMENTS

A. Embodiment

Figure 1:
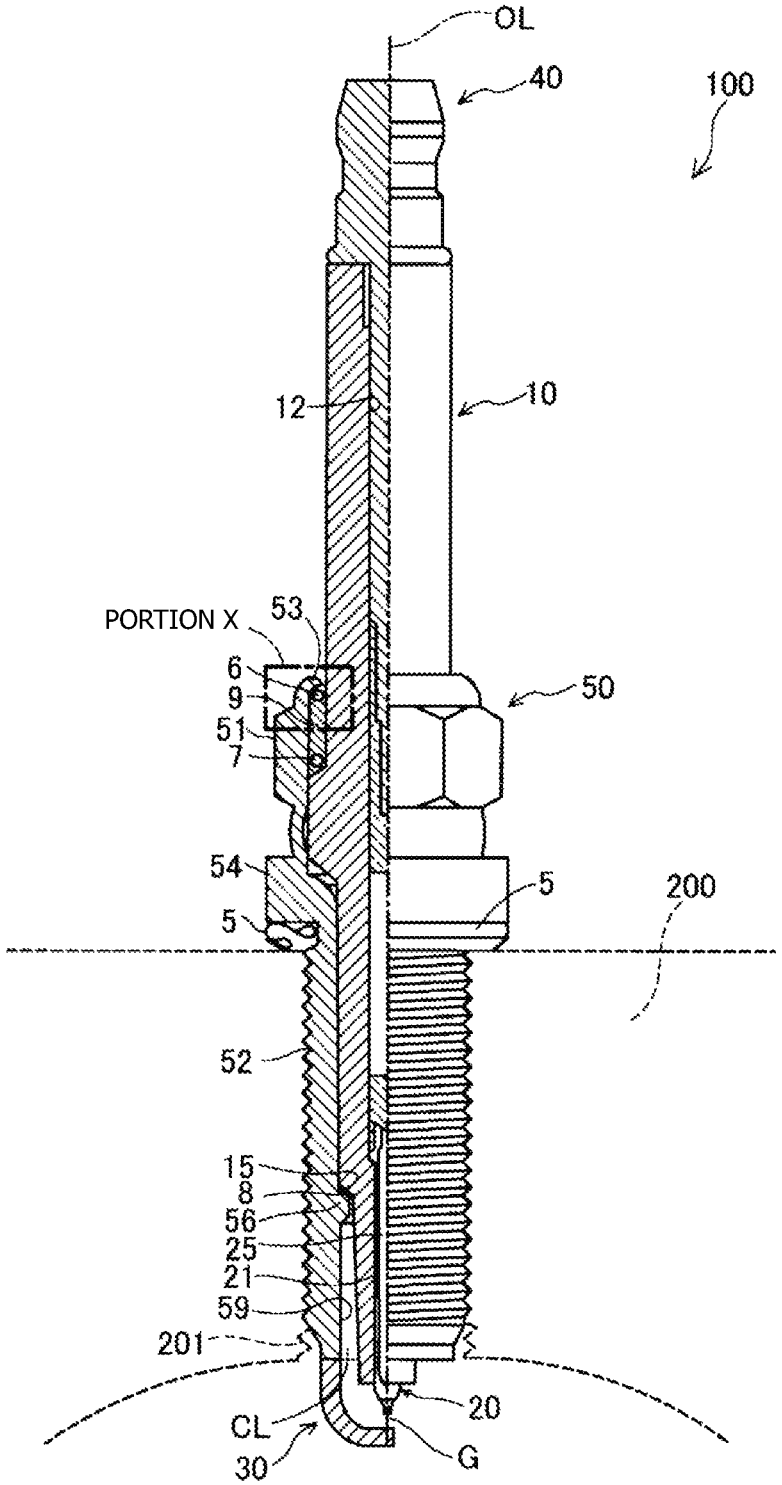
FIG. 1 is a partially sectioned view schematically showing the structure of a spark plug of one embodiment of the present invention.

A1. Structure of a Spark Plug:

FIG. 1 is a partially sectioned view schematically showing the structure of a spark plug 100 according to one embodiment of the present invention. In FIG. 1, the external structure of the spark plug 100 is shown on the right side of an axial line OL which is the center axis of the spark plug 100 (the center axis of the spark plug 100 coincides with that of a metallic shell 50). The cross-sectional structure of the spark plug 100 is shown on the left side of the axial line OL. Hereinafter, a direction parallel to a direction along the axial line OL will be referred to as the axial direction OD. The axial direction OD corresponds to the vertical direction in the drawing. The lower side in the drawing (the side where a ground electrode 30 to be described later is disposed) will be referred to as the forward end side, and the upper side in the drawing (the side where a metallic terminal member 40 to be described later is disposed) will be referred to as the rear end side.

The spark plug 100 includes a ceramic insulator 10 serving as an insulator, a center electrode 20, the ground electrode (external electrode) 30, the metallic terminal member 40, and the metallic shell 50. The ceramic insulator 10 is a tubular insulator having an axial hole 12 which is centrally located and which accommodates the center electrode 20 and the metallic terminal member 40. The ceramic insulator 10 is formed, for example, by firing a ceramic material such as alumina. The center electrode 20 is a generally rod-shaped electrode, and has a covering member 21 which is formed into the shape of a tube with a bottom, and a core member 25 embedded in the covering member 21. The core member 25 is higher in thermal conductivity than the covering member 21. The center electrode 20 is held by the ceramic insulator 10, and the ceramic insulator 10 is held by the metallic shell 50. The ground electrode 30 is a generally rod-shaped bent electrode, and is attached to the forward end of the metallic shell 50. The metallic terminal member 40 is attached to the rear end of the ceramic insulator 10. A spark gap G is formed between the free end of the ground electrode 30 and the forward end of the center electrode 20.

Figure 2:
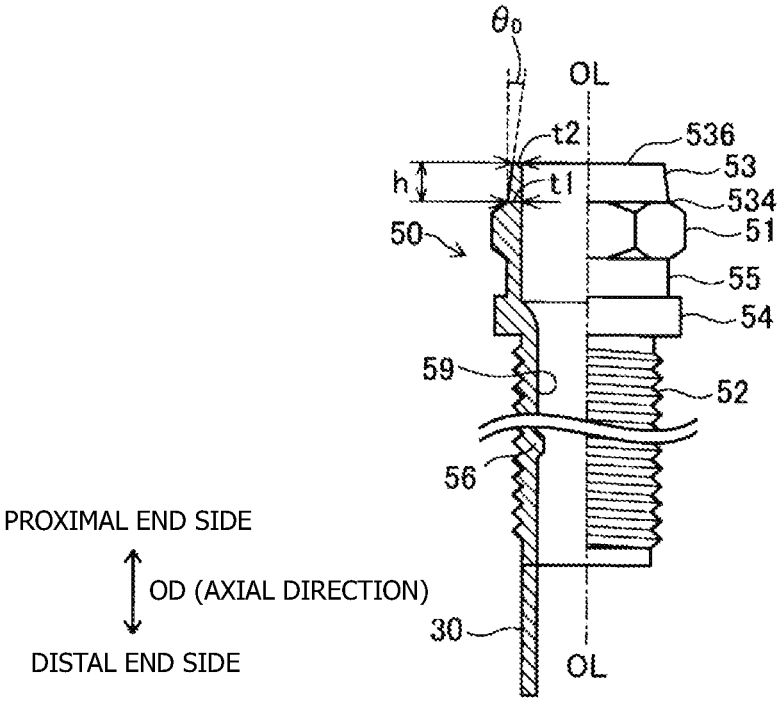
FIG. 2 is a partially sectioned view schematically showing the structure of a metallic shell before assembling.

FIG. 2 is a partially sectioned view schematically showing the structure of the metallic shell 50 before assembly. In FIG. 2, the external structure of the metallic shell 50 is shown on the right side of the axial line OL which is the center axis of the metallic shell 50. The cross-sectional structure of the metallic shell 50 is shown on the left side of the axial line OL. The metallic shell 50 is a generally cylindrical metallic member which has a through hole 59 extending in the axial direction OD and which accommodates and holds a portion of the ceramic insulator 10 in the through hole 59. A screw thread formed on the outer circumferential surface of the metallic shell 50 is brought into screw engagement with a screw hole 201 (see FIG. 1) formed in an engine head 200 (see FIG. 1) so as to attach the spark plug to the engine head 200. The metallic shell 50 is formed of a metal such as low carbon steel.

The metallic shell 50 is mainly composed of a crimp portion 53, a tool engagement portion 51, a compressible and deformable portion 55, a seal portion 54, and a screw portion 52 provided in this order from the rear end side in the axial direction.

The crimp portion 53 is generally annular and has a straight taper (with a taper angle of θ0) such that the thickness of the crimp portion 53 decreases from the root (hereinafter also referred to as "the crimp portion proximal end") where the crimp portion 53 is connected with the tool engagement portion 51 toward the crimp portion distal end 536 (the rear end in the axial direction). More specifically, the thickness t1 of the crimp portion proximal end 534 (hereinafter also referred to as the crimp portion proximal end thickness t1) is larger than the thickness t2 of the crimp portion distal end 536. In this embodiment, the thickness t1 of the crimp portion proximal end 534 is set to 1.20 mm or greater. As shown in FIG. 1, in a finished product of the spark plug 100, the crimp portion 53 is in a crimped state in which the crimp portion 53 is bent inward. The crimp portion 53 will be described in detail later.

The tool engagement portion 51 has a generally hexagonal shape in a plan view. A tool (spark plug wrench) is engaged with the tool engagement portion 51 when the spark plug 100 is attached to the engine head.

On the outer surface of the screw portion 52, there is formed a screw thread which comes into screw engagement with the screw hole of the engine head when the spark plug 100 is attached to the engine head. Also, an inwardly projecting step portion 56 is formed on the inner circumference of the screw portion 52. As will be described later, a diameter-reduced portion 15 of the ceramic insulator 10 is supported by the step portion 56 (see FIG. 1).

The seal portion 54 is formed between the screw portion 52 and the tool engagement portion 51 such that the seal portion 54 is continuous with the screw portion 52. When the spark plug 100 is attached to the engine head, the seal portion 54 prevents leakage of a gas in the engine through the screw hole formed on the engine head. When the spark plug 100 is attached to the engine head, as shown in FIG. 1, an annular gasket 5 formed by folding a plate member is inserted between the screw portion 52 and the seal portion 54. The seal portion 54 seals the screw hole of the engine head through the gasket 5. Thus, leakage of air-fuel mixture in the engine through the screw hole is prevented.

The compressible and deformable portion 55 is provided between the tool engagement portion 51 and the seal portion 54. The compressible and deformable portion 55 has a small thickness such that the compressible and deformable portion 55 deflects and deforms outward (see FIG. 1) as a result of application of a compressive force during crimping of the crimp portion 53, whereby the gastightness within the metallic shell 50 is improved. More specifically, as shown in FIG. 1, annular ring members 6 and 7 are interposed in a space between the outer circumferential surface of the ceramic insulator 10 and a portion of the inner circumferential surface of the metallic shell 50, the portion extending from the tool engagement portion 51 to the crimp portion 53. Powder of talc 9 is charged between the two ring members 6 and 7. When crimping is performed to bend the crimp portion 53 inward, the ceramic insulator 10 is pressed toward the forward end side within the metallic shell 50 via the ring members 6, 7 and the talc 9. As a result, the diameter-reduced portion 15 of the ceramic insulator 10 is supported by the step portion 56 formed on the inner circumference of the metallic shell 50, and the metallic shell 50 and the ceramic insulator 10 are united together. At that time, the gastightness between the metallic shell 50 and the ceramic insulator 10 is maintained by an annular sheet packing 8 interposed between the diameter-reduced portion 15 of the ceramic insulator 10 and the step portion 56 of the metallic shell 50, whereby leakage of combustion gas is prevented. The sheet packing 8 is formed of a material with high thermal conductivity such as copper, aluminum, or the like. If the thermal conductivity of the sheet packing 8 is high, heat of the ceramic insulator 10 is conducted efficiently to the step portion 56 of the metallic shell 50. Consequently, the heat dissipation performance of the spark plug 100 is improved, whereby the heat-resistance of the spark plug 100 can be enhanced. The compressible and deformable portion 55 deflects and deforms outward as a result of application of a compressive force during crimping, and improves the gastightness within the metallic shell 50 by increasing the compression stroke over which the talc 9 is compressed. In a region forward of the step portion 56 of the metallic shell 50, a clearance CL of a predetermined dimension is provided between the metallic shell 50 and the ceramic insulator 10.

A2. Structure of the Crimp Portion of the Metallic Shell:

FIGS. 3 to 6 are partial sectional views schematically showing on an enlarged scale a portion (portion X in FIG. 1) of the crimp portion 53. FIGS. 3 to 6 show distances A, B, and C and angle θ1 (which will be described later), which represent the crimped state of the crimp portion 53, and the crimp portion proximal end thickness t1.

Figure 3:
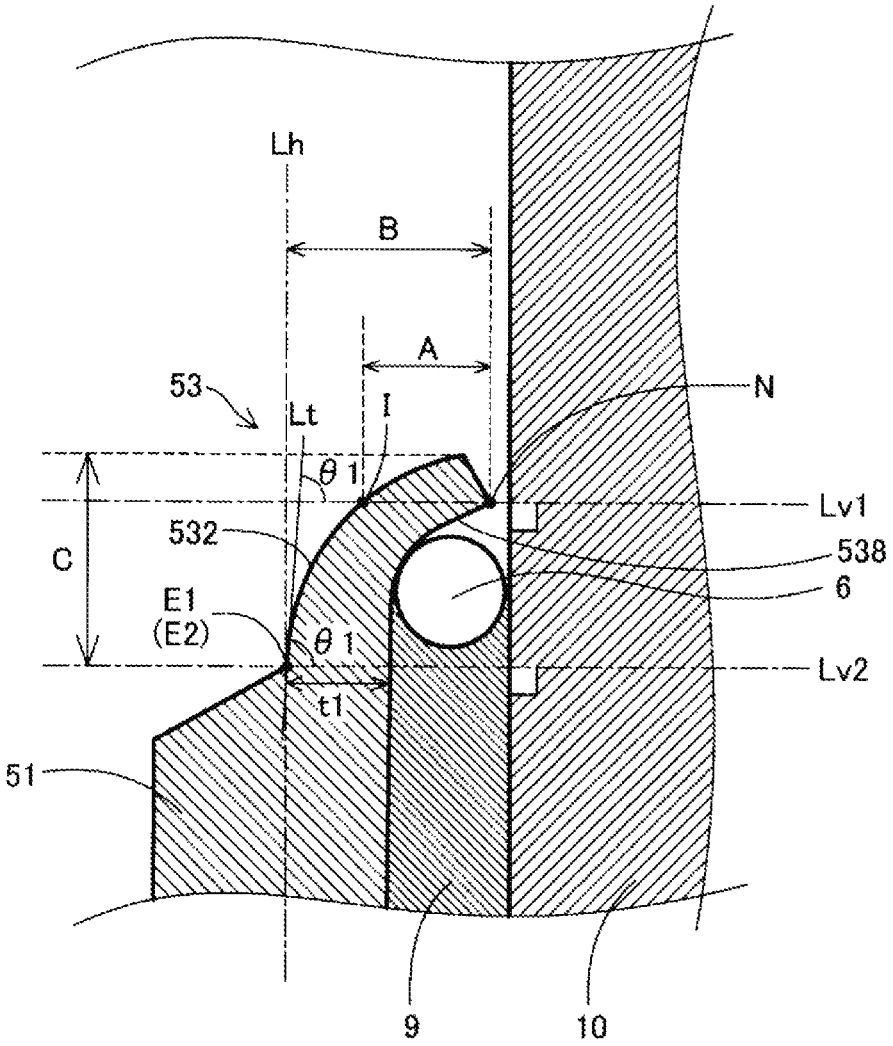
FIG. 3 is a partial sectional view schematically showing on an enlarged scale a portion of a crimp portion (in the case where C/B=1.0).

When the crimp portion 53 is crimped, the ceramic insulator 10 is inserted into the through hole 59 of the metallic shell 50, and the crimp portion 53 in an uncrimped state (see FIG. 2) is crimped by using a publicly known method (for example, the method disclosed in Japanese Patent Application Laid-Open (kokai) No. 2002-164147). In the method, the crimp portion 53 is pressed toward the forward end side in the axial direction by a crimping die. The above-mentioned distances A, B, and C and the angle θ1 are adjusted by adjusting the shape of the concave portion of the crimping die. In the present specification, the crimped state is represented by some of five parameters which are defined as follows on the basis of the shape of the crimp portion 53 in a cross section taken along a plane including the axial line OL. The parameters which represent the crimped state of the crimp portion 53 will now be described with reference to FIG. 3. As shown in FIG. 3, the crimp portion 53 is crimped inward such that a small gap is formed between the distal end of the crimp portion 53 and the ceramic insulator 10.

(1) Distance A: In the case where a point in the crimp portion 53 closest to the ceramic insulator 10 is defined as a closest point N and a line passing through the closest point N and orthogonal to the axial line OL is defined as a first orthogonal line Lv1, the distance between the closest point N and a point of intersection I between the first orthogonal line Lv1 and the outer circumference 532 of the crimp portion 53 is defined as the distance A.

(2) Distance B: In the case where the proximal end of the outer circumference 532 of the crimp portion 53 is defined as an outer circumference proximal point E1, the distance between the closest point N and a parallel line Lh which passes through the outer circumference proximal point E1 and is parallel to the axial line OL is defined as the distance B.

(3) Distance C: The maximum distance between the outer circumference 532 of the crimp portion 53 and a second orthogonal line Lv2 which passes through the outer circumference proximal point E1 and is orthogonal to the axial line OL is defined as the distance C.

(4) Curved portion angle θ1: The angle between the first orthogonal line Lv1 and a tangent line Lt at a curved portion proximal point E2 which is the proximal end of the curved portion of the outer circumference 532 of the crimp portion 53 is defined as the curved portion angle θ1. In FIG. 3, since the crimp portion 53 starts to curve at the crimp portion proximal end 534, the outer circumference proximal point E1 and the curved portion proximal point E2 coincide with each other. As shown in FIG. 3, the angle between the tangent line Lt and the first orthogonal line Lv1 is equal to the angle between the tangent line Lt and the second orthogonal line Lv2. Therefore, the angle θ1 between the tangent line Lt and the first orthogonal line Lv1 is the angle at the proximal point of the curved portion of the crimp portion 53.

(5) Crimp portion proximal end thickness t1: The thickness of the crimp portion proximal end 534 is defined as the crimp portion proximal end thickness t1. The crimp portion proximal end thickness t1 in the present embodiment corresponds to the thickness t at the proximal end of the crimp portion in claims.

Figure 4:
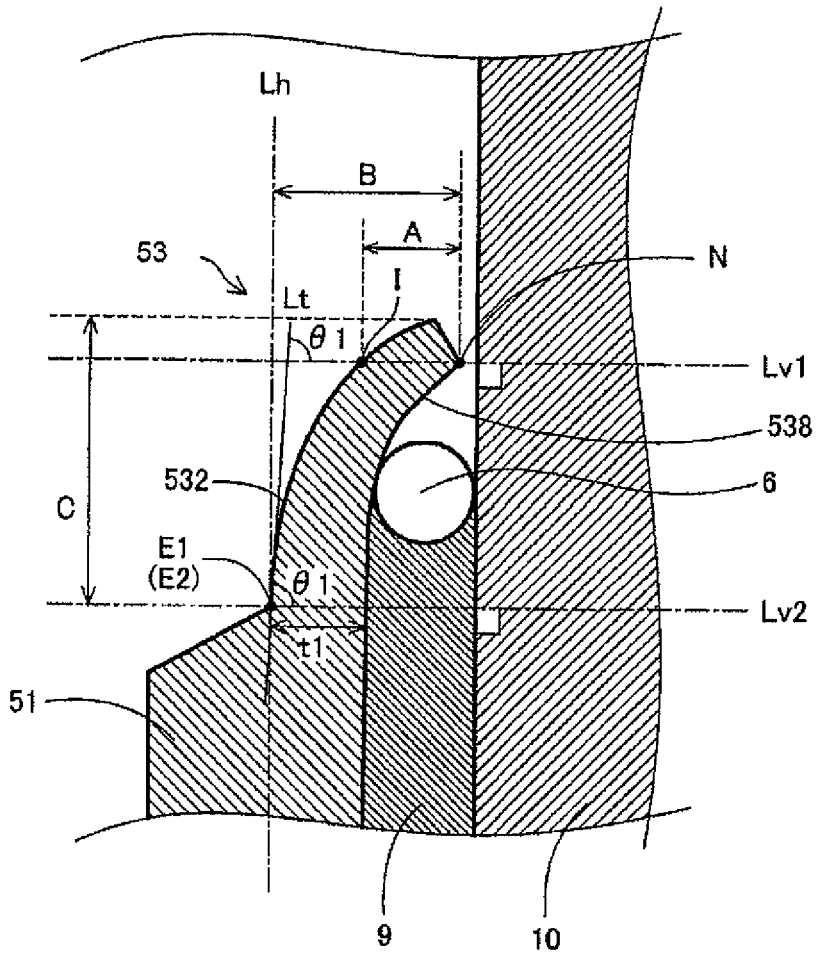
FIG. 4 is a partial sectional view of the crimp portion (in the case where C/B=1.5).

FIG. 3 shows an example where the ratio of the distance C to the distance B, i.e., C/B=1.0, and FIG. 4 shows an example where C/B=1.5. As shown in FIGS. 3 and 4, C/B changes in accordance with the degree of bending (angle) of the crimp portion 53 near the crimp portion distal end 536. That is, the smaller the value of C/B, the greater the degree of bending of the crimp portion 53 near the crimp portion distal end 536. In other words, the smaller the angle between the inner circumferential surface of the crimp portion 53 and a line parallel to the axial line OL, the smaller the degree of bending (when the angle is 0°, the crimp portion is not bent), and the larger the angle, the larger the degree of bending. The degree of bending near the crimp portion distal end 536 may be represented by, for example, an angle between a line parallel to the axial line OL and a tangent line at the point of contact between the inner circumference 538 of the crimp portion 53 and the ring member 6. In this case, the greater the angle, the smaller the value of C/B. In addition, the distance A changes in accordance with the degree of bending of the crimp portion 53 near the crimp portion distal end 536 and the thickness of the crimp portion 53. In the present description, the crimped state of the crimp portion 53 is represented by C/B; i.e., the ratio of the distance C to the distance B, and the distance A. These distances are defined as described above.

Figure 5:
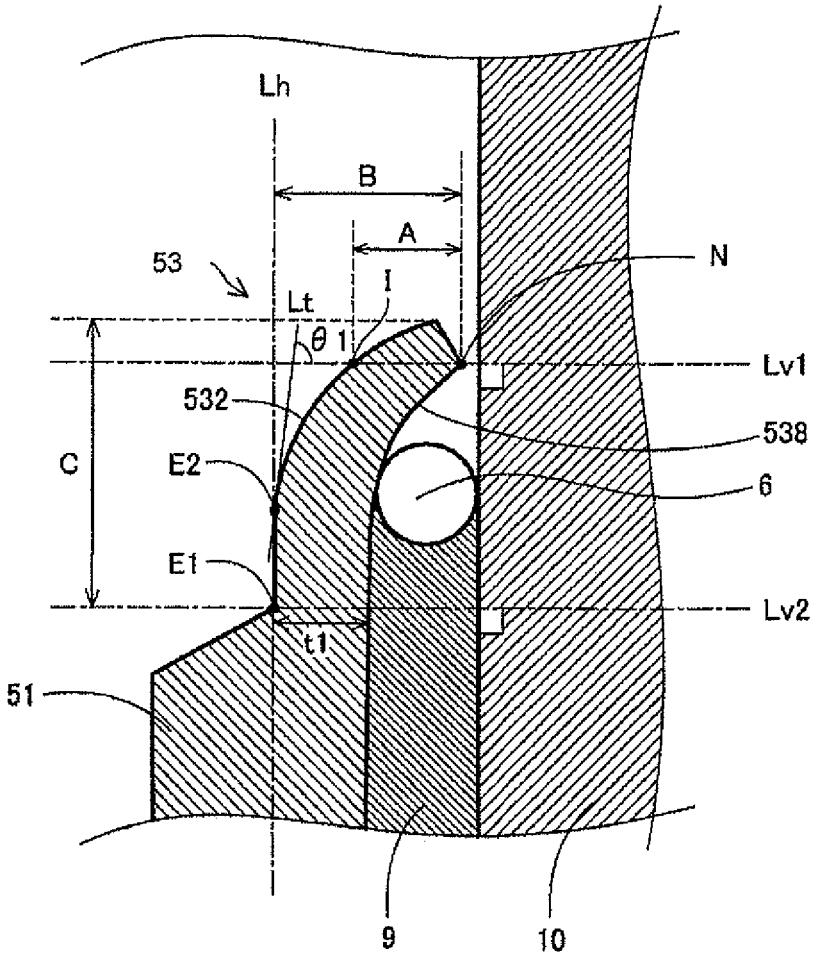
FIG. 5 is a partial sectional view of the crimp portion (in the case where the proximal point of a curved portion does not coincide with the proximal point E1 of an outer circumference).

FIG. 5 shows an example where the curved portion proximal point E2 does not coincide with the outer circumference proximal point E1. In FIGS. 3 and 4, the crimp portion 53 starts to curve at the crimp portion proximal end 534, and the curved portion proximal point E2 coincides with the outer circumference proximal point E1. In contrast, in the example shown in FIG. 5, the crimp portion 53 is straight (is in an uncrimped state) in a region extending from the crimp portion proximal end 534 to an arbitrary height, and starts to curve at the arbitrary height. Therefore, the curved portion proximal point E2 does not coincide with the outer circumference proximal point E1. That is, the outer circumference of the crimp portion 53 has a straight portion and a curved portion in a cross section passing through the axial line OL. In the present description, the proximal end (the end on the proximal end side of the crimp portion 53) of the curved portion is defined as the curved portion proximal point E2.

Figure 6:
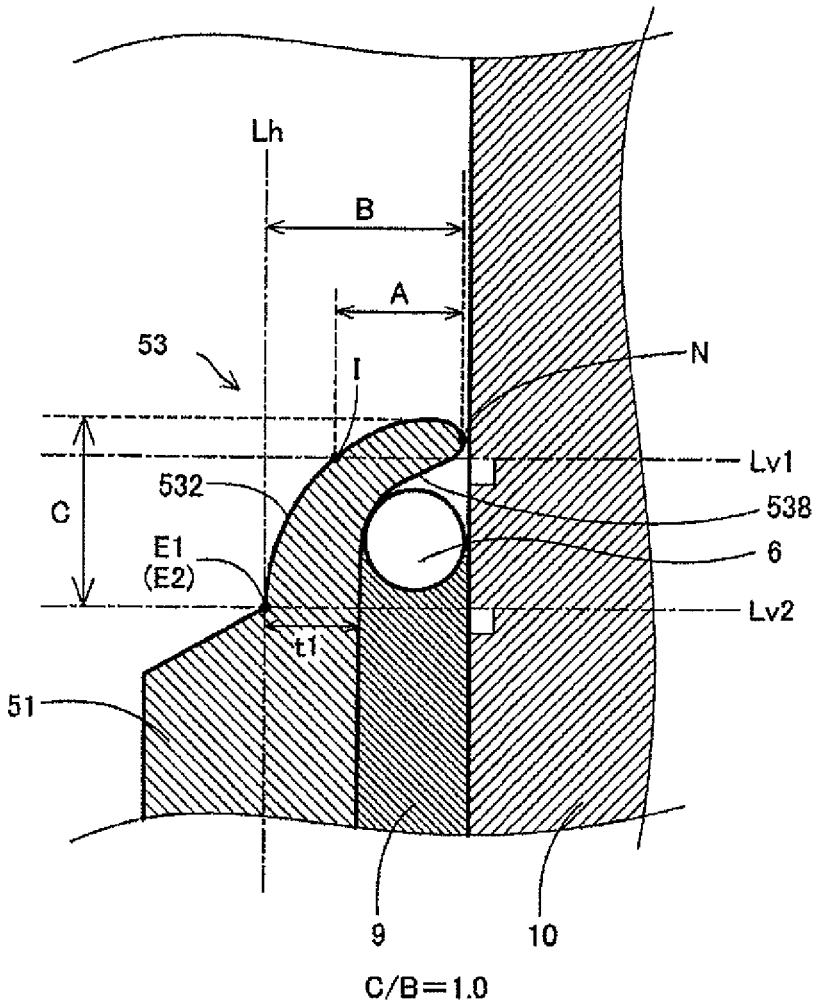
FIG. 6 is a partial sectional view of the crimp portion (another example of the closest point N).

FIG. 6 shows another example of the closest point N. In the examples shown in FIGS. 3 to 5, the crimp portion distal end 536 has approximately the same shape before and after crimping, and the distal end of the inner circumference of the crimp portion 53 is the closest point N. In the example shown in FIG. 6, the shape of the crimp portion distal end 536 have changed due to the load applied to the crimp portion 53 as a result of crimping by the crimping die, and the distal end surface of the crimp portion is closer to the ceramic insulator 10 than the distal end of the inner circumference of the crimp portion. In such a case, the closest point N is located at a position different from the distal end of the inner circumference of the crimp portion 53. In the present specification, regardless of change of the shape of the crimp portion distal end 536, the point closest to the ceramic insulator 10 in a cross section of the crimp portion 53 along a plane containing the axial line OL is defined as the closest point N.

In the present embodiment, in order to increase the crimp strength of the crimp portion 53, the crimp portion proximal end thickness t1 is set to 1.20 mm or greater (t1≥1.20 mm), and the distance A is set to 1.7 mm or greater (A≥1.7 mm). Further, it is preferred that a relation of 0.7≤C/B≤1.5 be satisfied. Also, it is preferred that a relation of 50°≤the curved portion angle θ1≤85° be satisfied. The angle of the crimp portion proximal end 534 (the angle between the tangent line at the outer circumference proximal point E1 and the second orthogonal line Lv2) was set to fall within a range of 70° to 90°. This is because when the angle of the crimp portion proximal end 534 is smaller than 70°, the tool engagement portion 51 may deflect and deform outward. Notably, it is preferred to render the distance A equal to or smaller than the distance B (the distance A≤the distance B)

for the following reason. The distance A becomes greater than the distance B (the distance A>the distance B) when the angle of the crimp portion proximal end 534 is greater than 90°, and in such a case, the tool engagement portion 51 may deflect and deform outward as described above.

B. Results of Evaluation Tests

Samples having the structure of the above-described embodiment in which the metallic shell 50 is assembled to the ceramic insulator 10 (the crimp portion 53 was crimped) were prepared, and two types of evaluation tests were performed to evaluate the crimp strength of the crimp portion 53. The first evaluation test is a test for evaluating the influence of the above-mentioned distance A on the crimp strength, and a second evaluation test is a test for evaluating the influence of C/B on the crimp strength. In these evaluation tests, a compressive load was applied to the ceramic insulator 10 of each sample from the forward end side thereof by using a compression testing machine (Autograph AG-X series, product of Shimadzu Corporation), and the maximum load (N) indicated by the Autograph machine was monitored. The maximum value of the compressive load (N) applied to the ceramic insulator 10 was used as the crimp strength (N).

B-1. The First Evaluation Test:

The crimp portions 53 of the metallic shells 50 of the plurality of samples used for the first evaluation test have the same inner diameter (17.87 mm) and different outer diameters D to thereby have different thicknesses t1. The crimp portions 53 have the same height h (FIG. 2) and the same taper angle θ0 (FIG. 2). In all the samples, C/B is 1.5. C/B is adjusted by changing the shape of the concave portion of the crimping die. The load applied by the crimping die during crimping is appropriately changed within a range of 75 to 120 kN. The results of the first evaluation test are shown in Table 1. Table 1 shows the relation between the distance A (FIG. 3) and the crimp strength (N) and also shows the crimp portion proximal end thickness t1 and the outer diameter D. It is noted when a spark plug (the distance A=1.6 mm) was disposed in a combustion chamber of an internal combustion engine having an increased degree of supercharging or an increased compression ratio and the internal combustion engine was operated, the ceramic insulator 10 came off the metallic shell 50. When the distance A of the crimp portion 53 of the metallic shell 50 was 1.6, the crimp strength was 16,668 N. For this reason, it is judged that the ceramic insulator is held by the metallic shell when the crimp strength is 17,000 N or greater. As shown in Table 1, the test was performed while the outer diameter of the crimp portion proximal end 534 was changed within a proper range.

TABLE 1

| Distance A (mm) | Crimp strength (N) | Crimp portion proximal end thickness t1 (mm) | Crimp portion proximal end diameter (mm) |
|---|---|---|---|
| 1.30 | 15520 | 0.93 | 19.7 |
| 1.40 | 15903 | 1.00 | 19.9 |
| 1.50 | 16286 | 1.06 | 20.0 |
| 1.60 | 16668 | 1.13 | 20.1 |
| 1.65 | 16860 | 1.17 | 20.2 |
| 1.70 | 17051 | 1.20 | 20.3 |
| 1.80 | 17434 | 1.27 | 20.4 |
| 1.90 | 17817 | 1.34 | 20.5 |
| 2.00 | 18200 | 1.40 | 20.7 |
| 2.10 | 18583 | 1.47 | 20.8 |

TABLE 1-continued

| Distance A (mm) | Crimp strength (N) | Crimp portion proximal end thickness t1 (mm) | Crimp portion proximal end diameter (mm) |
|---|---|---|---|
| 2.20 | 18965 | 1.54 | 20.9 |
| 2.30 | 19348 | 1.61 | 21.1 |
| 2.40 | 19731 | 1.67 | 21.2 |
| 2.50 | 20114 | 1.74 | 21.4 |
| 2.60 | 20497 | 1.81 | 21.5 |
| 2.70 | 20880 | 1.88 | 21.6 |
| 2.80 | 21262 | 1.95 | 21.8 |
| 2.90 | 21645 | 2.01 | 21.9 |
| 3.00 | 22028 | 2.08 | 22.0 |

In the range of the distance A shown in Table 1, the crimp strength which changed with the distance A had no local maximum and increased as the distance A increased. When the distance A was 1.7 mm or greater, the crimp strength was 17,000 N or greater. These results show that when the distance A is 1.7 mm or greater, a crimp strength of 17,000 N or greater is obtained.

B-2. The Second Evaluation Test:

In the second evaluation test, the crimp strength was evaluated for a plurality of samples in which the distance A was fixed to 1.7 mm, 2.3 mm, or 2.9 mm, and the ratio of the distance C to the distance B, i.e., C/B shown in FIG. 3 was changed. The distance A and C/B were adjusted by appropriately changing the crimp portion proximal end thickness t1, the height h (FIG. 2) of the crimp portion 53 before crimping, and the curved portion angle θ1.

TABLE 2

| | Crimp Strength (N) Distance A (mm) | | |
|---|---|---|---|
| C/B | 1.7 | 2.3 | 2.9 |
| 1.6 | 16628 | 18925 | 21222 |
| 1.5 | 17051 | 19348 | 21645 |
| 1.4 | 17475 | 19772 | 22068 |
| 1.3 | 17898 | 20195 | 22492 |
| 1.2 | 18321 | 20618 | 22915 |
| 1.1 | 18744 | 21041 | 23338 |
| 1.0 | 19168 | 21465 | 23762 |
| 0.9 | 19591 | 21888 | 24185 |
| 0.8 | 20014 | 22311 | 24608 |
| 0.7 | 19437 | 20734 | 22031 |
| 0.6 | 16861 | 18158 | 19455 |
| 0.5 | 14284 | 15581 | 16878 |

As shown in Table 2, in the case where the value of C/B is fixed, the crimp strength increases with the distance A. In the case where the distance A is fixed, the crimp strength becomes maximum when the value of C/B is 0.8 and the crimp strength decreases as the value of C/B increases from 0.8. This is because the degree of bending of the crimp portion 53 near the crimp portion distal end 536 decreases as the value of C/B increases as described above. In addition, when the value of C/B is excessively small, crimping fails. In the case where the distance A was 1.7 mm, the crimp strength was 17,000 N or greater when the relation of $0.7 \leq C/B \leq 1.5$ was satisfied. In the case where the distance A was 2.3 mm or 2.9 mm, the crimp strength was 17,000 N or greater when the relation of $0.6 \leq C/B$ was satisfied. These results demonstrate that the crimp strength of 17,000 N or greater is also obtained when the distance A is 1.7 mm or greater and the relation of $0.7 \leq C/B \leq 1.5$ is satisfied. Notably, in the second evaluation test, the crimp strength became 17,000 N or greater when the curved portion angle θ1 fell within the range of 50° to 85°.

The above-described test results shows that when the distance A of the crimp portion 53 of the metallic shell 50 is 1.7 mm or greater, a crimp strength of 17,000 N or greater is highly likely to be obtained. Thus, the ceramic insulator retaining performance of the metallic shell 50 is enhanced, and the ceramic insulator 10 is prevented from coming off the metallic shell 50. In addition, when the relation of $0.7 \leq C/B \leq 1.5$ is satisfied, the possibility that a crimp strength of 17,000 N or greater is obtained increases.

C. Modifications

The present invention is not limited to the above-described embodiment, but may be embodied in various other forms without departing from the spirit of the invention. For example, in order to solve, partially or entirely, the above-mentioned problem or yield, partially or entirely, the above-mentioned effects, technical features of the embodiments corresponding to technical features of the modes described in the section "SUMMARY OF THE INVENTION" can be replaced or combined as appropriate. Also, the technical feature(s) may be eliminated as appropriate unless the present specification mentions that the technical feature(s) is essential. For example, the following modifications are possible.

C-1. First Modification

The diameter of the ceramic insulator 10 of the spark plug 100, and the thickness and height of the crimp portion 53 of the metallic shell 50 of the spark plug 100 are not limited to the values employed in the above-described embodiment. The minimum requirement is that the distance A (FIG. 3) is 1.7 mm or greater. The thickness and height of the crimp portion 53 and the curved portion angle θ1 are appropriately adjusted such that the distance A becomes 1.7 mm or greater. Further, it is preferred to set the thickness and height of the crimp portion 53 such that the relation of $0.7 \leq C/B \leq 1.5$ is satisfied.

C-2. Second Modification

The above-described embodiment shows the example in which the annular ring members 6 and 7 are interposed between the outer circumferential surface of the ceramic insulator 10 and a portion of the inner circumferential surface of the metallic shell 50, which portion extends from the tool engagement portion 51 to the crimp portion 53, and powder of talc 9 is charged between the two ring members 6 and 7. However, the ring members 6 and 7 and the talc 9 may be omitted. In other words, the spark plug 100 may be configured such that the crimp portion 53 of the metallic shell 50 directly presses the ceramic insulator 10.

DESCRIPTION OF REFERENCE NUMERALS

5 . . . gasket
6 . . . ring member
8 . . . sheet packing
9 . . . talc
10 . . . insulator
12 . . . axial hole
15 . . . diameter-reduced portion
20 . . . center electrode
21 . . . covering member
25 . . . core member
30 . . . ground electrode
40 . . . metallic terminal member
50 . . . metallic shell
51 . . . tool engagement portion
52 . . . screw portion
53 . . . crimp portion
54 . . . seal portion
55 . . . compressible and deformable portion
56 . . . step portion
59 . . . through hole
100 . . . spark plug Having described the invention, the following is claimed:

1. A spark plug comprising:

a ceramic insulator having a generally tubular shape and a through hole extending in a direction of an axial line, the ceramic insulator including a center electrode on a forward end side of the through hole in the direction of the axial line; and a metallic shell formed in a generally tubular shape and having a crimp portion at a rear end of the metallic shell in the direction of the axial line, the crimp portion holding the ceramic insulator in a state in which the ceramic insulator is inserted into the metallic shell, wherein the crimp portion satisfies a relation of $A \geq 1.7$ mm and a relation of $t1 \geq 1.20$ mm in a cross section of the crimp portion taken along a plane containing the axial line, where A is a distance between a closest point N which is a point within the cross section closest to the ceramic insulator and a point of intersection at which a first orthogonal line passing through the closest point and orthogonal to the axial line intersects with an outer circumference of the crimp portion, and t1 is a thickness of a proximal end of the crimp portion.

2. A spark plug according to claim 1, wherein the crimp portion satisfies a relation of $0.7 \leq C/B \leq 1.5$, where C/B is the ratio of a distance C to a distance B in the cross section, the distance B being a distance between the closest point and a parallel line which passes through a proximal point of the outer circumference of the crimp portion and which is parallel to the axial line, and the distance C being a maximum distance between the outer circumference of the crimp portion and a second orthogonal line which passes through the proximal point of the outer circumference of the crimp portion and which is orthogonal to the axial line.

* * * * *